United States Patent [19]

Fierst

[11] 4,000,746

[45] Jan. 4, 1977

[54] PANTY GIRDLE CONSTRUCTION

[76] Inventor: Jeannette I. Fierst, 2 Weybridge Road, Great Neck, N.Y. 11023

[22] Filed: June 4, 1975

[21] Appl. No.: 584,021

Related U.S. Application Data

[63] Continuation-in-part of Ser. No. 275,738, July 27, 1972, abandoned.

[52] U.S. Cl. ..... 128/526

[51] Int. Cl.[2] ..... A41C 1/00

[58] Field of Search ..... 128/526, 527, 528, 529, 128/530, 558, 560, 561518 R, 572, 573

[56] References Cited

UNITED STATES PATENTS

| | | | |
|---|---|---|---|
| 2,444,829 | 7/1948 | Karcher | 128/572 |
| 2,453,063 | 11/1948 | Cohen | 128/527 |
| 2,506,488 | 5/1950 | Cass | 128/526 |
| 2,875,763 | 3/1959 | Marchisella | 128/529 X |
| 2,896,633 | 7/1959 | McKee | 128/526 |
| 3,097,651 | 7/1963 | Lehman | 128/526 |
| 3,171,413 | 3/1965 | Jones | 128/527 |
| 3,279,469 | 10/1966 | Schustack | 128/526 |
| R22,738 | 4/1946 | Clark | 128/527 |

*Primary Examiner*—G. V. Larkin
*Attorney, Agent, or Firm*—Charles E. Temko

[57] ABSTRACT

A woman's panty girdle including a pair of thigh-enclosing leg portions, interconnected by a crotch portion. Detachably attaching fastener means extends from a lower edge of one pant leg to a forward part of the crotch, and in a substantially rectilinear path to a point on a front panel above an opposite leg, thereby facilitating the opening of the lower part of the girdle for toilet purposes without the necessity of lowering or removing the garment, and without the formation of a loose portion which may become soiled. Means are provided in the leg portions for adjusting their size to adapt to the size of the wearer's thighs.

10 Claims, 10 Drawing Figures

FIG. 1
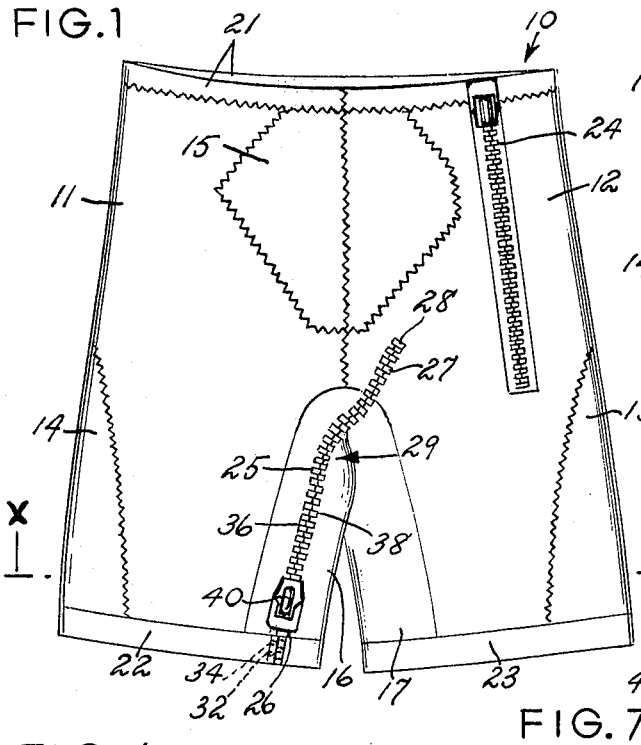
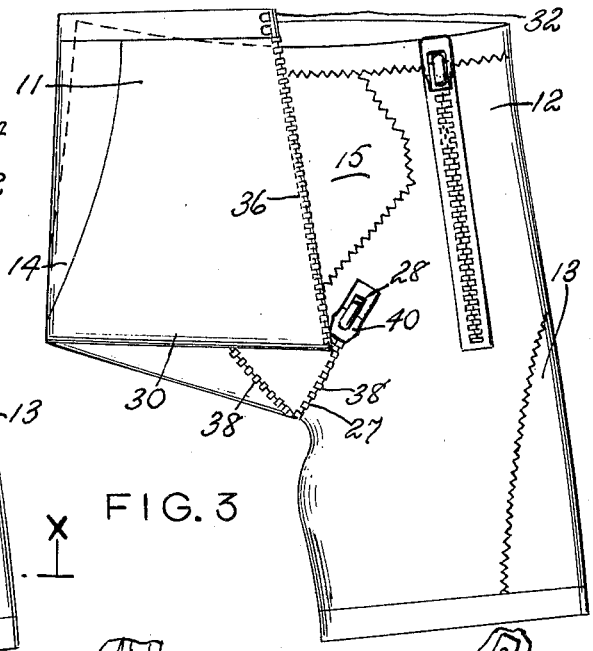
FIG. 3
FIG. 7
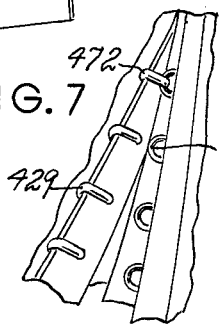
FIG. 8
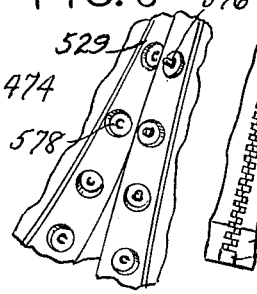
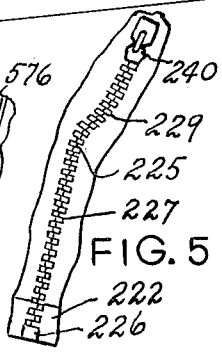
FIG. 5
FIG. 4
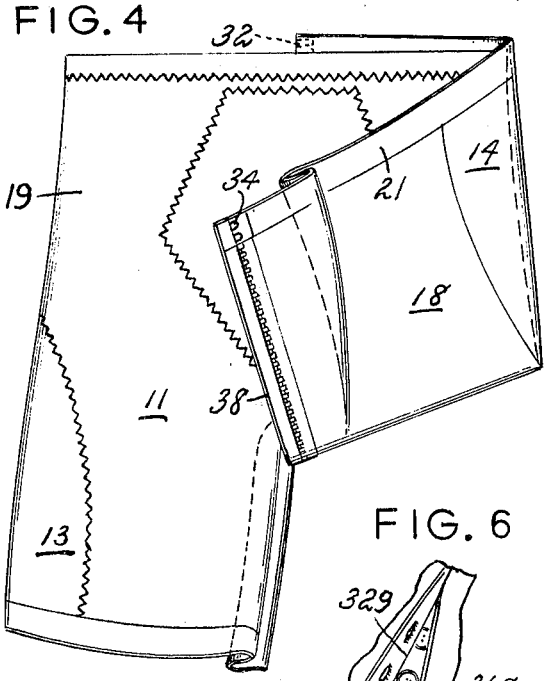
FIG. 6
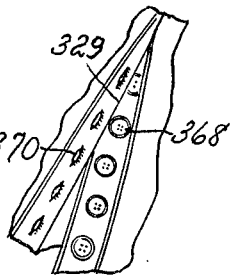
FIG. 2
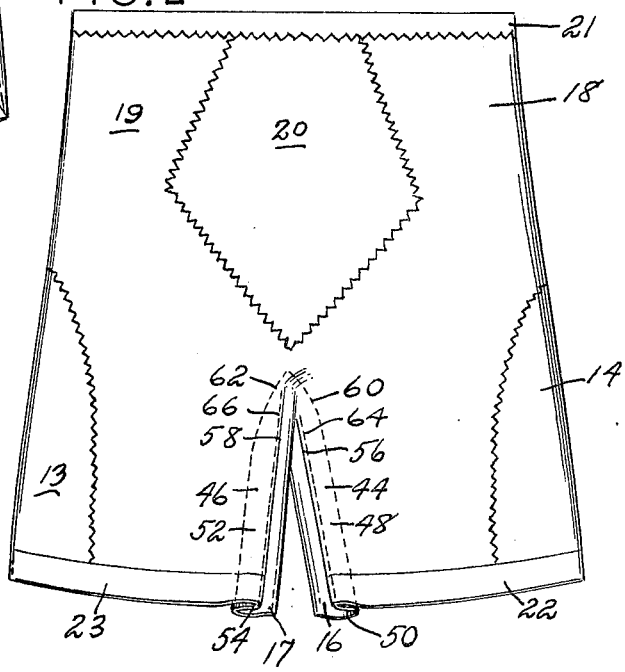
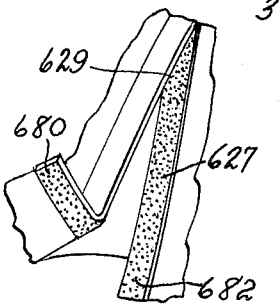
FIG. 9
FIG. 10
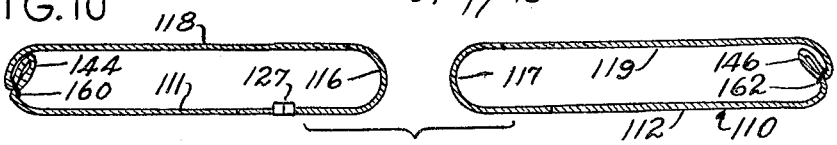

PANTY GIRDLE CONSTRUCTION

This application is a continuation-in-part of Ser. No. 275,738 filed July 27, 1972, and now abandoned.

This invention relates generally to the field of women's panty girdles, and more particularly to an improved type having provision for opening the lower portion thereof for toilet purposes and for size adjustment. Devices of this general type are known in the art, and the invention lies in specific constructional details which permit improved facility in opening the same, and improved convenience in use while the lower portion of the garment is in opened condition, and for size adjustment.

BRIEF DESCRIPTION OF THE PRIOR ART

The prior art includes U.S. Pat. No. 2,381,953 which discloses a construction in which a panty girdle has a pair of rear panels which are extended over the buttocks of the wearer, and the meeting edges of the panels are detachably interconnected by a slide fastener. The Karcher, U.S. Pat. No. 2,444,829 discloses a comparable structure applied to a regular girdle, and includes a slide fastener-closed rear opening. The McKee, U.S. Pat. No. 2,896,633 discloses a girdle in which a crotch piece is droppable by opening a slide fastener, the slide fastener being arranged in an arc so that it commences and terminates at the forward lower edge of the garment. The Jeffrey, U.S. Pat. No. 3,036,574 discloses a bathing suit of a type having a pants-like nether portion. A slide fastener closure extends across the front of the garment underneath a skirt-like flap which produces a drop seat.

The Lehman, U.S. Pat. No. 3,097,651 discloses a panty girdle having two leg portions and a crotch portion of soft material. A slide fastener of detachable type commences at a lower edge of the front part of one leg, and travels upward at a diagonal angle, and turns downwardly in an arc terminating at the lower edge of the other leg.

The above structures, while not without utility, are accompanied with a disadvantage in that once the lower part of the garment has been opened, there is formed a flap of loose material without any means for supporting the same in an elevated condition, so that this flap may become easily soiled.

BRIEF DESCRIPTION OF THE PRESENT INVENTION

Briefly stated, the invention contemplates the provision of a panty girdle having two leg portions interconnected by a crotch portion. A detachably attaching fastener extends from the lower edge of one of the leg portions, and extends across the crotch portion at a forward part thereof to terminate at a point on a panel overlying the front of the opposite leg portion. When the girdle is opened at the lower portion thereof, one leg stays intact and the parts forming the other leg and part of the crotch are then folded about a substantially horzontal line above the crotch of the wearer, to be maintained in such position by tension of the interconnected parts of the girdle which are maintained in normal position. Owing to the curvature of the body of the wearer, these folded parts will tend to remain in folded condition until they are returned by the user to normal position and the detachably attachable fastener closure means is closed.

BRIEF DESCRIPTION OF THE DRAWING

In the drawing, to which reference will be made in the specification, similar reference characters have been employed to designate corresponding parts throughout the several views.

FIG. 1 is a front elevational view of a preferred embodiment of the invention.

FIG. 2 is a rear elevational view thereof.

FIG. 3 is a front elevational view thereof showing the lower portion of the device in opened condition.

FIG. 4 is a rear elevational view of the device in opened condition.

FIG. 5 is a fragmentary elevational view of the front of the girdle of FIG. 1 showing a modified form of slide fastener.

FIG. 6 is a fragmentary view corresponding to FIG. 5 but showing buttons and button holes as a modified form of closure means.

FIG. 7 is a fragmentary view corresponding to FIG. 5 but showing hooks and eyes as a modified form of closure means.

FIG. 8 is a fragmentary view corresponding to FIG. 5 but showing male and female snap fasteners as a modified form of closure means.

FIG 9 is a fragmentary view corresponding to FIG. 5 but showing hooks and loops of the VELCRO type as a modified form of closure means. FIG. 10 is an enlarged horizontal sectional view, somewhat schematic, as might be seen from the plane X — X on FIG. 1, showing a modification of the size adjusting elements.

DETAILED DESCRIPTION OF THE DISCLOSED EMBODIMENT

Turning to FIGS. 1 to 4 inclusive, the girdle, generally indicated by reference character 10, comprises a right front panel 11, a left front panel 12, a right side panel 14, a left side panel 13, a forward center panel 15, and right and left crotch panels 16 and 17, respectively. Referring to FIG. 2, the girdle may include corresponding rear panels 18 and 19, and a rear center panel 20. An elastic upper band 21 cooperates with the lower right and left leg bands 22 and 23 to position the girdle upon the torso of the wearer. Suitable means, as for example a side mounted slide fastener 24 facilitates donning and doffing the garment.

Commencing at a point 26 and then extending along the right crotch panel 16 in an upward direction and over the left crotch panel 17 to terminate at a point 28 on left front front panel 12 is an elongated notch opening 25 which is normally closed by the detachably attachable fastener closure means 29. In the embodiment shown in FIG. 1, the means 29 includes a slide fastener 27, and complementary hooks 32 and eyes 34 at the two meeting ends of the lower right leg band 22. In the closed condition of the notch opening, the edges 36 and 38 thereof are juxtaposed, the slide fastener slider 40 is in the lowermost position thereof, and the hooks and eyes 32 and 34 are interengaged. Thus, as the garment is worn, tension in the right leg band 22 is taken by the hooks and eyes 32 and 34 and accidental opening by the separation of the toothed runners of the slide fastener 27 is prevented.

The garment 10 may be donned with the slide fastener 27 and the hooks and eyes 32 and 34 in engaged condition, use of the side mounted slide fastener 24, and the normal resiliency of the garment and of the bands 22 and 23 permitting this operation. When it is desired to open the lower portion of the garment, the hooks and eyes 32 and 34 are disengaged, and the slider 40 is raised from its lowermost position as seen in FIG. 1 to its uppermost position as seen in FIG. 3. Next, as seen in FIGS. 3 and 4, those parts of the right front panel 11, right side panel 14, right rear panel 18, and right crotch panel, which are thereby released, are folded upwardly about a substantially horizontal line 30 positioned as high as possible above the crotch of the wearer, leaving the left leg of the wearer in completely enclosed condition. So long as the garment 10 remains in normal condition on the wearer, the folded upward parts will remain tensioned to a degree sufficient to maintain them in turned relation upon the right hip of the wearer, with little, if any, tendency to fall, irrespective of whether the wearer is in a seated or standing position. With the shiftable parts in their elevated position, the user may then conveniently perform her toilet without any danger of soiling any parts of the garment. Upon completion, the folded parts of the garment are lowered to their original position, and the slide fastener 27 and hooks and eyes 32 and 34 are returned to their interengaged positions.

As seen in FIG. 2, in order to accommodate the leg portions of the garment 10, to wearers having thicker thighs, size adjusting elements 44 and 46 are provided. The elements 44 and 46 each comprise two plies 48 and 50, and 52 and 54, respectively of the fabric of which the nether portions of the garment 10 are composed. The said plies are formed by folds with the bights 56 and 58 preferably juxtaposing each other to accomplish symmetry and balance. The elements 44 and 46 are normally maintained in unextended condition by stitches 60, 62, 64, and 66. The stitches 60 and 62 each engage two plies of fabric and serve to maintain plies 48 and 50, and 52 and 54 respectively in laminar relationship. The stitches 64 and 66 engage the bights 56 and 58 respectively and connect them to the interconnection between the rear panels 18 and 19 and the crotch panels 16 and 17 respectively. I have deemed it most desirable to so circumferentially locate the said elements 44 and 46, but it will be apparent to those skilled in the art to which the present invention relates, that they may be located at any desired position along the circumference of legs of the garment 10. When the wearer finds that there is excessive restriction or constriction upon her thighs by the legs of the garment, it is a simple and convenient matter to pull the stitches 60, 62, 64 and 66, which releases the elements 44 and 46 allowing them to open up and increase the effective circumference of each of the leg portions of the garment.

In the modification shown in FIG. 10, the size adjusting elements 144 and 146 are located at the lateral outer portions of the girdle 110 and are inwardly disposed. To avoid needless repetition, certain of the parts corresponding to the embodiment shown in FIGS. 1 to 4 inclusive are given the same reference characters with the addition of the prefix "1".

Elements 144 and 146 each comprise a bight and two plies of the fabric of which the nether portions of the garment 110 are composed.

The elements 144 and 146 are normally maintained in the unextended condition thereof, by vertically disposed rows of stitches 160 and 162. The stitches 160 and 162 each engage two plies of fabric which are maintained in laminar relationship thereby.

When the wearer finds that there is excessive restriction or constriction upon her thighs by the leg portions of the garment 110, the rows of stitches 160 and 162 are pulled out, thereby allowing the size adjusting elements 144 and 146 to open up and increase the effective size of each of the leg portions of the garment.

In FIG. 5 there is seen a modification of the closure means. For the purpose of avoiding needless repetition, certain of the parts in the modifications are given the same reference characters with the addition of appropriate prefixes. The closure means 229 differs from the first described embodiment in that the slide fastener 227 is of the fully separable type, so that in the fully engaged closed position thereof, the slider 240 is at the top of the elongated notch opening 225. Since in this type of fastener the connection is initiated by a pin and socket interengagement at the bottom portion thereof, this occurs at the lower right leg band, and the need for the hooks 32 and eyes 34 is obviated. By this construction, even if there is partial disengagement at the upper portion of the slide fastener 227, interconnection at the point 226 will be maintained.

FIG. 6 shows another modification of the closure means. The closure means 329 comprises a row of buttons 368 adapted for detachably attachable engagement with correspondingly positioned loops or button holes 370.

FIG. 7 illustrates another modification of the closure means. The closure means 429 comprises a row of hooks 472 adapted for detachably attachable engagement with correspondingly positioned eyes 474. In effect these are an upward continuation of the hooks 32 and eyes 34.

FIG. 8 has closure means 529 which comprise a row of male snap fastener elements 576 detachably engageable with female snap fastener elements 578.

In FIG. 9 the closure means 629 is in the form of fabric strips or tapes having hooks 680 and loops 682. This structure for fastening in a detachable manner is of the VELCRO type and is indicated by reference character 627.

In the present description, the designations "right" and "left" are oriented with respect to the wearer's right and left hands, and it will be apparent that where desired the positions of the various parts may be reversed, for example to especially accomodate a "left handed" wearer.

I wish it to be understood that I do not consider the invention limited to the precise details of structure shown and set forth in this specification, for obvious modifications will occur to those skilled in the art to which the invention pertains.

I claim:

1. In a panty girdle of a type including a pair of leg portions normally enclosing at least partially the thighs of a wearer, and including a pair of front panels and a permanently attached crotch member interconnecting said front panels, the improvement comprising: detachably attachable fastener closure means having first and second edges and extending upwardly from a lower edge of one of said legs of said girdle across a forwardly disposed portion of said crotch member and terminating at a point substantially above said crotch member on a front panel forming a part of the other of said legs; whereby, when said fastener closure means is separated the said edges may be separated and the parts of said girdle forming said first mentioned leg may be folded upwardly along a substantially horizontal line disposed substantially above the crotch of the wearer to be maintained in such condition by tension imparted by the shape of the body of the wearer and the remaining parts of the girdle.

2. Structure in accordance with claim 1, in which the closure means is a slide fastener including means to prevent accidental disconnection at the lower edge of the associated leg.

3. Structure in accordance with claim 2, in which the slide fastener is of an end separable type.

4. Structure in accordance with claim 1, in which the closure means comprises buttons on said first edge, the opposite second edge thereat having correspondingly positioned button holes.

5. Structure in accordance with claim 1, in which the closure means comprises hooks on said first edge, the opposite second edge thereat having correspondingly positioned eyes.

6. Structure in accordance with claim 1, in which the closure means comprises female snap fastener members on said first edge, the opposite second edge thereat having correspondingly positioned male snap fastener members.

7. Structure in accordance with claim 1, in which the closure means comprises hooks on said first edge, the opposite edge thereat having correspondingly positioned loops, said hooks and loops being of the VELCRO type.

8. Structure in accordance with claim 1, in which the closure means comprises intermeshing elements of a slide fastener of the "zipper" type.

9. Structure in accordance with claim 1 in which at least one of the leg portions has a size adjusting element.

10. Structure in accordance with claim 9 in which the size adjusting element comprises a substantially vertically directed fold forming bight which is maintained in unextended condition by a row of stitches.

* * * * *